US006124831A

United States Patent [19]

Rutkowski et al.

[11] Patent Number: 6,124,831

[45] Date of Patent: Sep. 26, 2000

[54] FOLDED DUAL FREQUENCY BAND ANTENNAS FOR WIRELESS COMMUNICATORS

[75] Inventors: Kim Rutkowski, Raleigh; Gerard James Hayes, Wake Forest, both of N.C.

[73] Assignee: Ericsson Inc., Research Triangle Park, N.C.

[21] Appl. No.: 09/358,993

[22] Filed: Jul. 22, 1999

[51] Int. Cl.[7] ..... H01Q 1/38

[52] U.S. Cl. ..... 343/700 MS; 343/702; 343/895

[58] Field of Search ..... 343/700 MS, 702, 343/895; H01Q 1/38

[56] References Cited

U.S. PATENT DOCUMENTS 5,986,609 11/1999 Spall ..... 343/700 MS 6,028,567 2/2000 Lahti ..... 343/702

6,040,803 3/2000 Spall ..... 343/700 MS

*Primary Examiner*—Don Wong

*Assistant Examiner*—Hoang Nguyen

*Attorney, Agent, or Firm*—Myers Bigel Sibley & Sajovec, P.A.

[57] ABSTRACT

A C-shaped dielectric substrate having a folded configuration includes opposite first and second spaced apart portions joined at respective adjacent end portions by a third portion. A continuous trace of conductive material, which serves as a radiating element, is disposed on the outer surfaces of the dielectric substrate first, second and third portions. The portion of the continuous radiating element disposed on the dielectric substrate first portion is configured to electrically couple with the portion of the continuous radiating element disposed on the dielectric substrate second portion such that at least two separate and distinct frequency bands are created.

26 Claims, 4 Drawing Sheets

FOLDED DUAL FREQUENCY BAND ANTENNAS FOR WIRELESS COMMUNICATORS

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Radiotelephones typically include an antenna for transmitting and/or receiving wireless communications signals. Historically, monopole and dipole antennas have perhaps been most widely employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11–12 centimeters in length. As a result, antennas utilized by radiotelephones have also undergone miniaturization. In addition, it is becoming desirable for radiotelephones to be able to operate within widely separated frequency bands in order to utilize more than one communications system. For example, GSM (Global System for Mobile communication) is a digital mobile telephone system that typically operates at a low frequency band, such as between 880 MHz and 960 MHz. DCS (Digital Communication System) is a digital mobile telephone system that typically operates at high frequency bands between 1710 MHz and 1880 MHz.

Small radiotelephone antennas typically operate within narrow frequency bands. As a result, it can be difficult for conventional radiotelephone antennas to operate over widely separated frequency bands. Furthermore, as radiotelephone antennas become smaller, the frequency bands within which they can operate typically become narrower.

Helix antennas are increasingly being utilized in handheld radiotelephones that operate within multiple frequency bands. Helix antennas typically include a conducting member wound in a helical pattern. As the radiating element of a helix antenna is wound about an axis, the axial length of the helix antenna can be considerably less than the length of a comparable monopole antenna. Thus, helix antennas may often be employed where the length of a monopole antenna is prohibitive.

FIG. 1 illustrates a conventional helix antenna 5 configured for dual frequency band operation. As shown in FIG. 1, the antenna 5 generally includes an antenna feed structure 6, a radiating element 7, and a parasitic element 8. The radiating element 7 and parasitic element 8 are housed within a plastic tube or radome 9 with an end cap 10. Unfortunately, helix antennas can be somewhat complex to manufacture, particularly with regard to positioning of the radiating and parasitic elements 7, 8.

Branch antennas are also being utilized in handheld radiotelephones that operate within multiple frequency bands. Branch antennas typically include a pair of conductive traces disposed on a substrate that serve as radiating elements and that diverge from a single feed point. FIG. 2 illustrates a conventional branch antenna 15 configured for dual frequency band operation. As shown in FIG. 2, the antenna 15 generally includes a flat substrate 16 having a pair of meandering radiating elements 17*a*, 17*b* disposed thereon. The meandering radiating elements 17*a*, 17*b* diverge from a feed point 18 that electrically connects the antenna 15 to RF circuitry within a radiotelephone. Each of the meandering radiating elements 17*a*, 17*b* is configured to resonate within a respective frequency band.

Unfortunately, branch antennas may transmit and receive electrical signals within a band of frequencies that are too narrow for radiotelephone operation. Furthermore, in order to decrease the size of a branch antenna, it is typically necessary to compress the meandering pattern of each radiating element. Unfortunately, as the meandering pattern of a radiating element becomes more compressed, the frequency band within which the radiating element can operate typically becomes more narrow.

Thus, in light of the above-mentioned demand for multiple frequency band radiotelephones and the problems with conventional antennas for such radiotelephones, a need exists for small radiotelephone antennas that are capable of operating in multiple widely separated frequency bands.

SUMMARY OF THE INVENTION

It is, therefore, an object of the present invention to provide small antennas for wireless communicators, such as radiotelephones, that are capable of operating in multiple, widely separated frequency bands.

It is also an object of the present invention to facilitate radiotelephone miniaturization.

These and other objects of the present invention can be provided by a folded, C-shaped antenna having a continuous radiating element disposed on the inner or outer surface thereof. The antenna includes a dielectric substrate having opposite first and second spaced apart portions joined at respective adjacent end portions by a third portion. A continuous trace of conductive material, which serves as the continuous radiating element, is disposed on the inner or outer surfaces of the dielectric substrate first, second and third portions.

An elongated spacer preferably is disposed between the dielectric substrate first and second portions. The elongated spacer is preferably an elongated dielectric spacer that is formed from an open-celled microcellular polymer and includes opposite first and second surfaces. The dielectric spacer first surface is in contacting face-to-face relationship with an inner surface of the dielectric substrate first portion and the dielectric spacer second surface is in contacting face-to-face relationship with an inner surface of the dielectric substrate second portion.

However, it is understood that a spacer need not be utilized between the dielectric substrate first and second portions. An air gap between the dielectric substrate first and second portions may suffice.

A portion of the continuous radiating element disposed on the dielectric substrate first portion has a meandering pattern and is electrically connected to a feed point. The portion of the continuous radiating element disposed on the dielectric substrate first portion is configured to electrically couple with the portion of the continuous radiating element disposed on the dielectric substrate second portion such that the antenna resonates within different first and second frequency bands.

According to another embodiment of the present invention, a C-shaped dielectric substrate includes first and second radiating elements (e.g., conductive copper traces) disposed on respective first and second portions of the substrate. The first and second radiating elements are configured to electrically couple with each other such that the antenna resonates within separate and distinct (i.e., low and high) frequency bands. The first and second radiating elements are electrically connected to each other by a conductive via formed through the dielectric spacer.

Antennas according to the present invention are particularly well suited for operation within various communications systems utilizing multiple, widely separated frequency bands. Furthermore, because of their small size, antennas according to the present invention can be utilized within very small communications devices. In addition, because a single substrate is utilized, antennas according to the present invention can be easier to manufacture than conventional dual-band antennas.

DETAILED DESCRIPTION OF THE INVENTION

Figure 1:
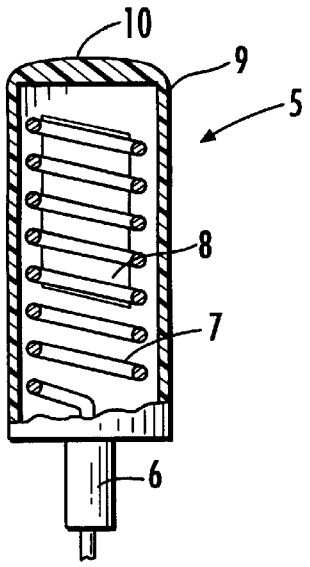
FIG. 1. (PRIOR ART)
FIG. 1 is a side section view of a conventional helix antenna that is configured for dual frequency band radiotelephone operation.
Figure 2:
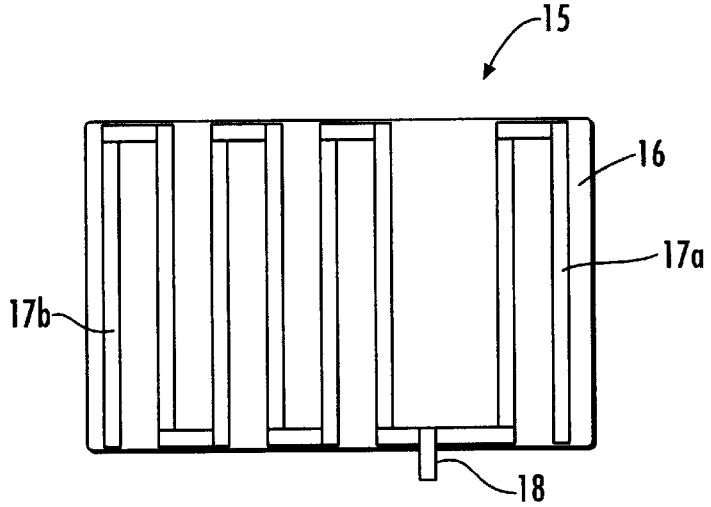
FIG. 2. (PRIOR ART)
FIG. 2 is a plan view of a conventional branch antenna that is configured for dual frequency band radiotelephone operation.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present. Moreover, each embodiment described and illustrated herein includes its complementary conductivity type embodiment as well.

Figure 3:
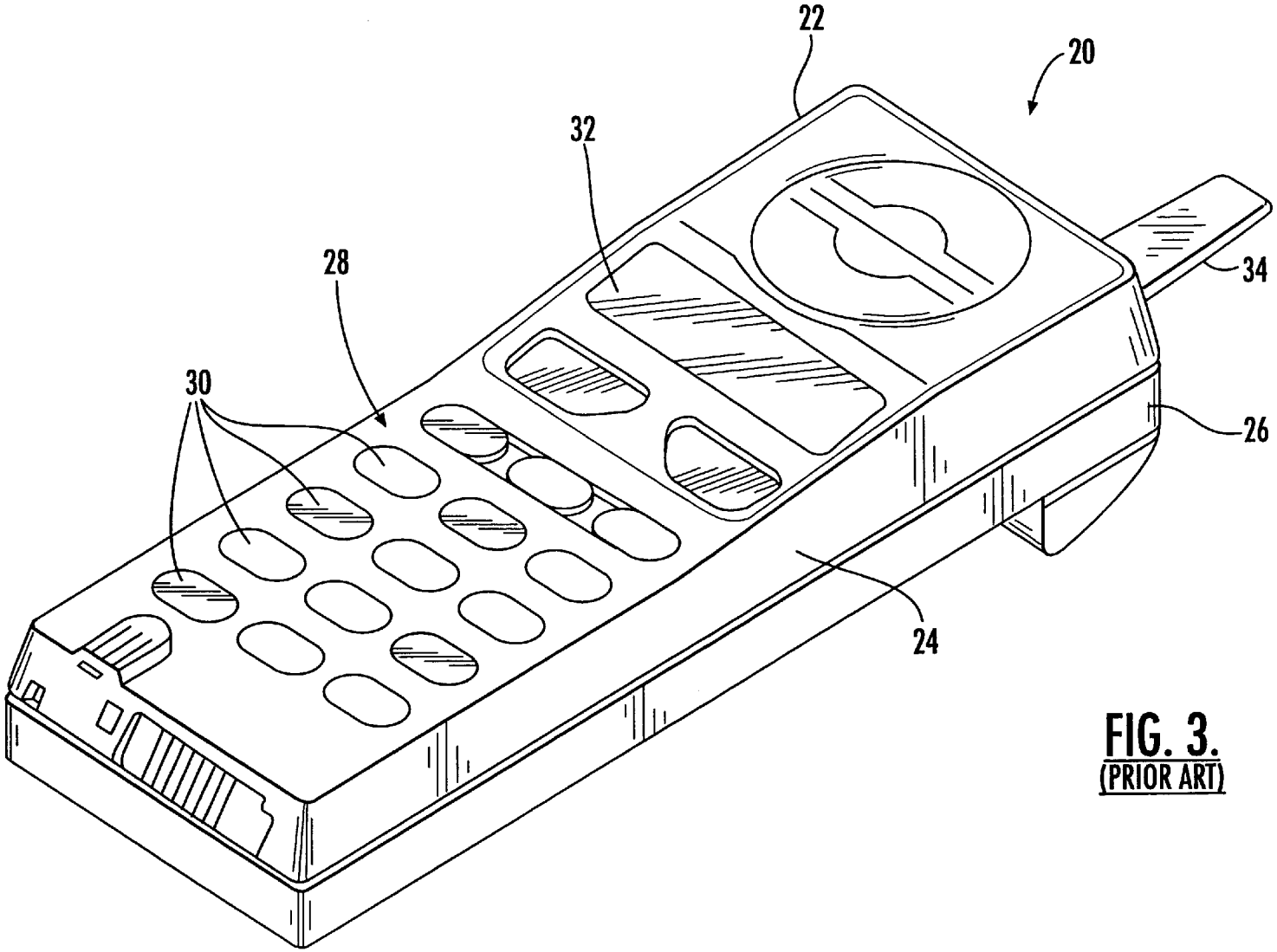
FIG. 3. (PRIOR ART)
FIG. 3 is a perspective view of an exemplary radiotelephone within which an antenna according to the present invention may be incorporated.

Referring now to FIG. 3, a radiotelephone 20 within which an antenna according to the present invention may be incorporated is illustrated. The housing 22 of the illustrated radiotelephone 20 includes a top portion 24 and a bottom portion 26 connected thereto to form a cavity therein. Top and bottom housing portions 24, 26 house a keypad 28 including a plurality of keys 30, a display 32, and electronic components (not shown) that enable the radiotelephone 20 to transmit and receive radiotelephone communications signals. An antenna according to the present invention may be located within the illustrated radome 34.

Figure 4:
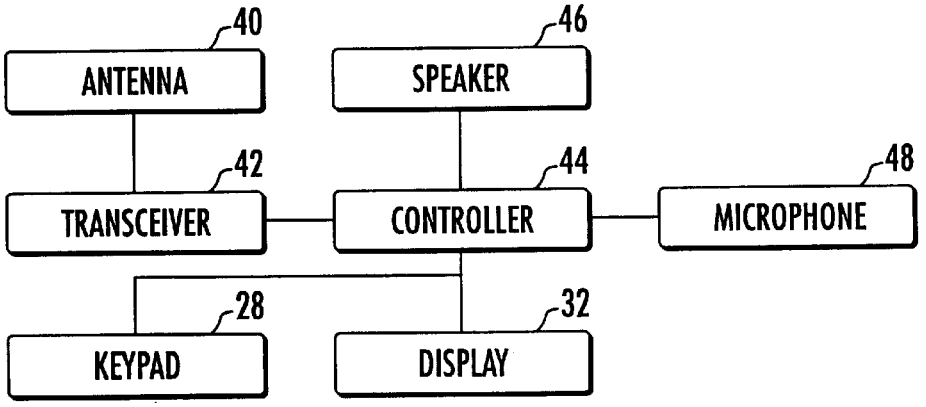
FIG. 4. (PRIOR ART)
FIG. 4 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 4, and is understood by those skilled in the art of radiotelephone communications. An antenna 40 for receiving and transmitting radiotelephone communication signals is electrically connected to a radio-frequency transceiver 42 that is further electrically connected to a controller 44, such as a microprocessor. The controller 44 is electrically connected to a speaker 46 that transmits a remote signal from the controller 44 to a user of a radiotelephone. The controller 44 is also electrically connected to a microphone 48 that receives a voice signal from a user and transmits the voice signal through the controller 44 and transceiver 42 to a remote device. The controller 44 is electrically connected to a keypad 28 and display 32 that facilitate radiotelephone operation.

Antennas according to the present invention may also be used with wireless communications devices which only transmit or receive radio frequency signals. Such devices which only receive signals may include conventional AM/FM radios or any receiver utilizing an antenna. Devices which only transmit signals may include remote data input devices.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 5:
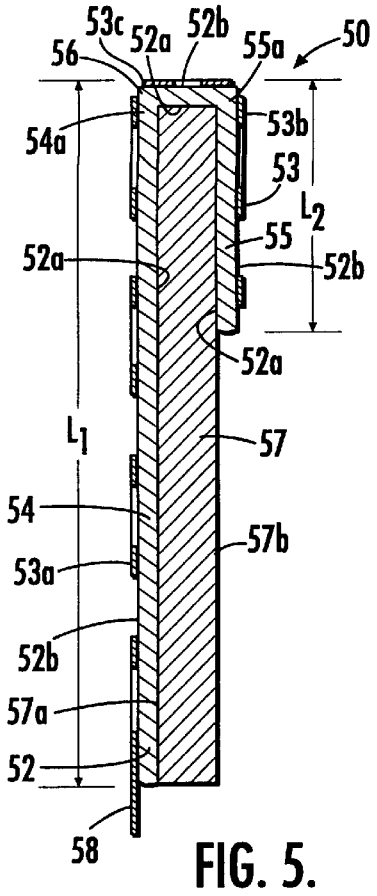
FIG. 5 is a side view of an antenna, according to an embodiment of the present invention, that is configured for dual frequency band radiotelephone operation.

Referring now to FIG. 5, a dual frequency band antenna 50 in accordance with an embodiment of the present invention is illustrated. The illustrated antenna 50 includes a C-shaped dielectric substrate 52 having a continuous radiating element (e.g., conductive copper trace) 53 disposed thereon. The C-shaped dielectric substrate 52 includes opposite first and second spaced apart portions 54, 55 joined at respective adjacent end portions 54*a*, 55*a* by a third portion 56. The first, second and third portions 54, 55, 56 each have opposite inner and outer surfaces 52*a*, 52*b*. In the illustrated embodiment, the dielectric substrate first portion 54 has a first length $L_1$ and second portion 55 has a second length $L_2$ that is less than the length $L_1$ of the first portion 54.

An elongated spacer 57 is disposed between the dielectric substrate first and second portions 54, 55, as illustrated, and is preferably formed from dielectric material. The elongated spacer 57 has opposite first and second surfaces 57*a*, 57*b*. The spacer first surface 57*a* is in contacting face-to-face relationship with the inner surface 52*a* of the dielectric substrate first portion 54. The spacer second surface 57*b* is in contacting face-to-face relationship with the inner surface 52*a* of the dielectric substrate second portion 55.

Preferably, the spacer 57 is formed from an open-cell microcellular polymer, such as PORON® urethane from Rogers Corporation, 245 Woodstock Road, Woodstock, Conn. 06281-1815. The average cell size for PORON® urethanes is about 100 microns and is generally uniform. The term "open-cell" means that there are small openings between most of the cells producing a breathable material. When compressed these openings are closed off creating a seal. However, it is understood that the dielectric spacer may be formed from various dielectric materials and is not limited to PORON®.

It is understood that a spacer need not be utilized between the dielectric substrate first and second portions 54, 55. An air gap between the dielectric substrate first and second portions 54, 55 may suffice.

A continuous radiating element 53 is disposed on the outer surface 52*b* of the dielectric substrate first, second and third portions 54, 55, 56, as illustrated. The continuous radiating element 53 includes a first portion 53*a* disposed on the first portion 54 of the dielectric substrate 52, a second portion 53*b* disposed on the second portion 55 of the dielectric substrate 52, and a third portion 53*c* disposed on the third portion 56 of the dielectric substrate 52. The first portion 53*a* of the continuous radiating element 53 is electrically connected to a feed point 58 that electrically connects the antenna 50 to RF circuitry within a wireless communicator, such as a radiotelephone.

In the illustrated embodiment, the radiating element first portion 53*a* has a meandering pattern with a respective electrical length that is configured to couple with the radiating element second portion 53*b* to create at least two separate and distinct frequency bands, for example between 824 MHz and 960 MHz (i.e., a low frequency band) and between 1710 MHz and 1990 MHz (i.e., a high frequency band). As would be known by one of skill in the art, the term "coupling" refers to the association of two or more circuits or systems in such a way that power or signal information may be transferred from one to another.

Figure 6A:
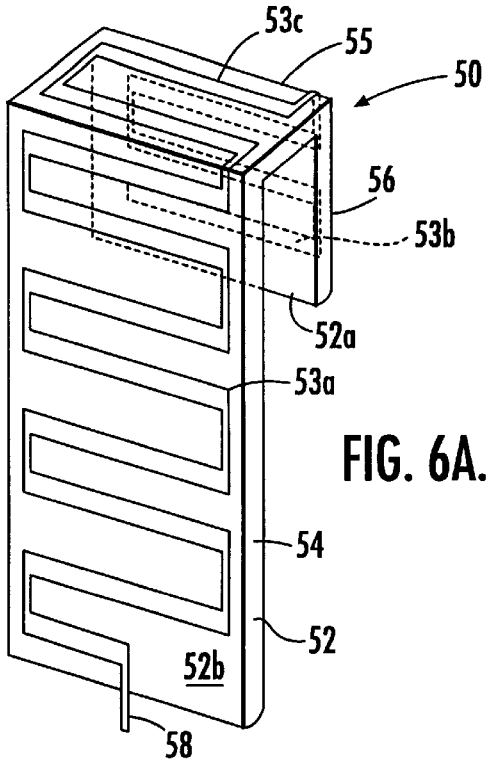
FIG. 6A is a front perspective view of the antenna of FIG. 5 with the dielectric spacer removed for clarity.
Figure 6B:
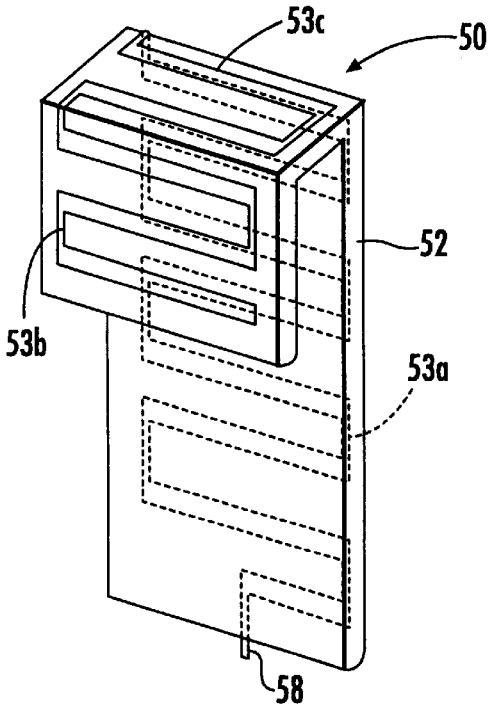
FIG. 6B is a rear perspective view of the antenna of FIG. 5 with the dielectric spacer removed for clarity.
Figure 7:
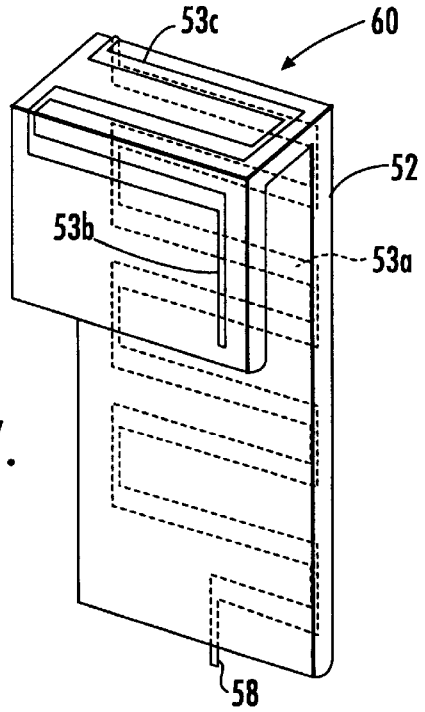
FIG. 7 is rear perspective view of the antenna of FIG. 5 wherein the radiating element along the back side of the folded substrate has an alternative pattern.

FIGS. 6A and 6B are front and rear perspective views, respectively, of the antenna of FIG. 5 with the spacer removed for clarity. In the illustrated embodiment of FIGS. 5 and 6A–6B, the radiating element 53 has a meandering pattern. However, it is understood that each of the first, second and third portions 53*a*, 53*b*, 53*c* of the radiating element 53 may have various configurations. For example, as illustrated in FIG. 7, the second portion 53*b* of the radiating element 53 may have a non-meandering configuration.

A particularly preferable material for use as the dielectric substrate 52 is FR4 or polyimide, which is well known to those having skill in the art of communications devices. However, various dielectric materials may be utilized for the dielectric substrate 52. Preferably, the dielectric substrate 52 has a dielectric constant between about 2 and about 4 for the illustrated embodiment. However, it is to be understood that dielectric substrates having different dielectric constants may be utilized without departing from the spirit and intent of the present invention.

Dimensions of the illustrated radiating element first and second portions 53*a*, 53*b* may vary depending on the space limitations of the substrate outer surface 52*b*. A preferred conductive material for use as a radiating element is copper. Typically, the thickness of the radiating element first and second portions 53*a*, 53*b* is between about 0.05–1.0 mm.

The electrical length of the radiating element first and second portions 53*a*, 53*b* is a tuning parameter, as is known to those skilled in the art. The bandwidth of the antenna 50 may be adjusted by changing the shape and configuration of the meandering patterns of the radiating element first and second portions 53*a*, 53*b*, as would be known to those skilled in the art.

Figure 8:
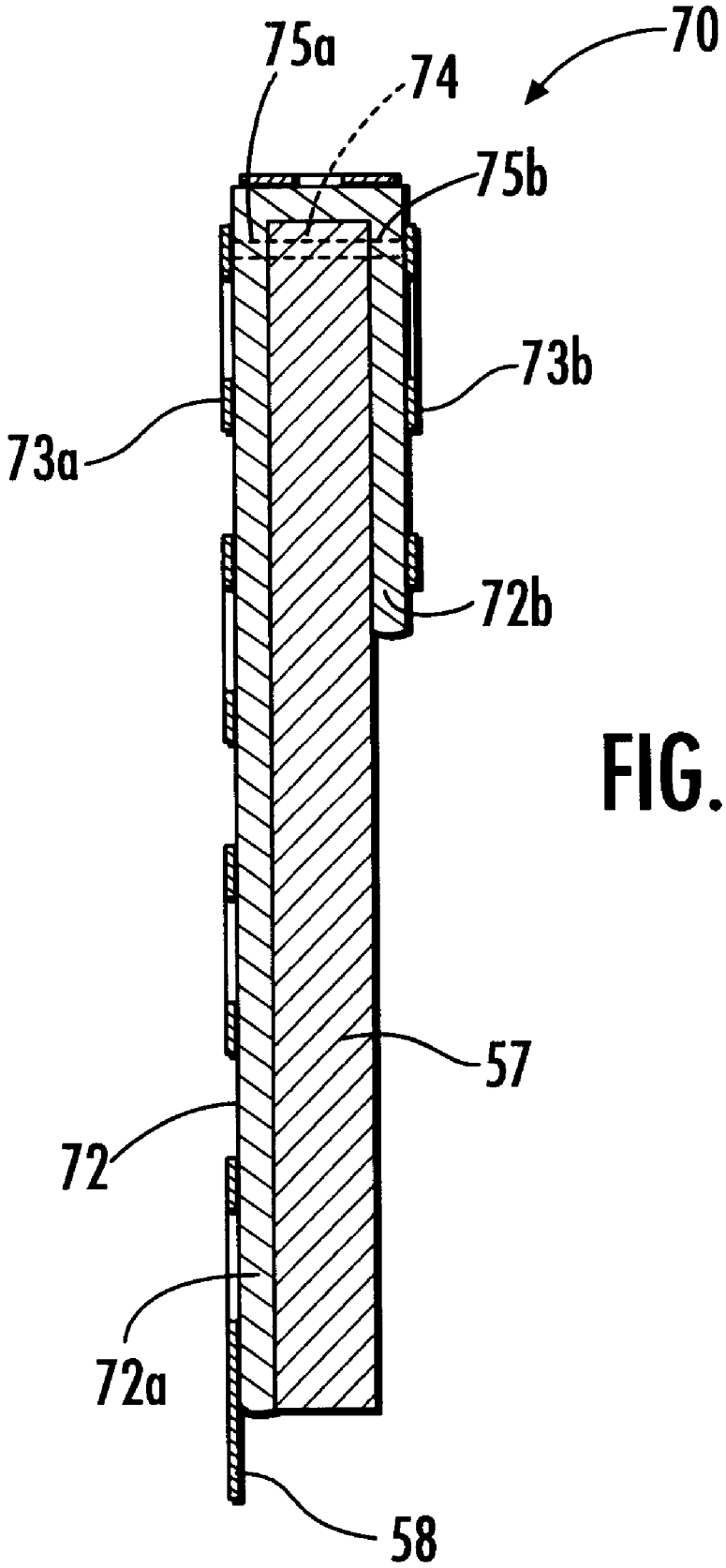
FIG. 8 is a side view of an antenna, according to another embodiment of the present invention, that is configured for dual frequency band radiotelephone operation and wherein the first and second radiating elements are electrically connected by a conductive via extending through the dielectric spacer.

Referring now to FIG. 8, a dual frequency band antenna 70 in accordance with another embodiment of the present invention is illustrated. The illustrated antenna 70 includes a C-shaped dielectric substrate 72 having first and second radiating elements (e.g., conductive copper traces) 73*a*, 73*b* disposed on respective first and second portions 72*a*, 72*b* of the substrate 72. The first and second radiating elements 73*a*, 73*b* are configured to electrically couple with each other such that the antenna 70 resonates within at least two separate and distinct frequency bands.

The first radiating element 73*a* is electrically connected to a feed point 58 disposed on the dielectric substrate first portion 72*a*. The first and second radiating elements 73*a*, 73*b* are electrically connected to each other by a conductive via 74 formed through the spacer 57. In the illustrated embodiment, electrical leads 75*a*, 75*b* facilitate electrical contact between the first and second radiating element 73*a*, 73*b*, respectively, and the conductive via 74.

The low frequency bands of GSM are between about 880 MHz and 960 MHz, corresponding to a bandwidth of 80 MHz. The low frequency bands of AMPS (Advanced Mobile Phone Service) are between about 824 MHz and 894 MHz, corresponding to a bandwidth of 70 MHz. The high frequency bands of PCS (Personal Communications System) are between about 1850 MHz and 1990 MHz, corresponding to a bandwidth of 140 MHz. The high frequency bands of DCS are between about 1710 MHz and 1880 MHz, corresponding to a bandwidth of 170 MHz. Accordingly, for a radiotelephone antenna to operate adequately at a low frequency band (e.g., for GSM or AMPS), it should have a bandwidth of between about 70 MHz–80 MHz. Similarly, for a radiotelephone antenna to operate adequately at a high frequency band (e.g., for PCS or DCS), it should have a bandwidth of between about 140 MHz–170 MHz.

Table 1 below illustrates the bandwidth attainable by the antenna illustrated in FIGS. 5 and 6A–6B for various lengths $L_2$ of the radiating element second portion 53*b*.

TABLE 1

| | Low Band | | High Band | |
|---|---|---|---|---|
| $L_2$ (mm) | Center Frequency of Resonance (MHz) | Bandwidth (MHz) of 2:1 VSWR | Center Frequency of Resonance (MHz) | Bandwidth (MHz) of 2:1 VSWR |
| 23 | 962 | 103 | 1,838 | 232 |
| 20 | 1,004 | 163 | 1,906 | 311 |
| 17 | 1,043 | 166 | 1,965 | 212 |
| 14 | 1,086 | 144 | 2,074 | 163 |

As illustrated in Table 1, the optimum length $L_2$ of the radiating element second portion 53*b* is 20 millimeters (mm). At a length $L_2$ of 20 mm, the antenna of FIGS. 5 and 6A–6B has a low band center frequency of 1,004 MHz with a bandwidth of 163 MHz and a high band center frequency of 1,906 MHz with a bandwidth of 311. At a length $L_2$ *of* 20 mm, the antenna of FIGS. 5 and 6A–6B has adequate bandwidth for operation within the widely separated frequency bands of GSM, AMPS, PCS and DCS.

It is to be understood that the present invention is not limited to the illustrated embodiments of FIGS. 5, 6A–6B, 7, and 8. Various other configurations incorporating aspects of the present invention may be utilized, without limitation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A multiple frequency band antenna, comprising:

a C-shaped dielectric substrate comprising opposite first and second spaced apart portions joined at respective adjacent end portions by a third portion, wherein the dielectric substrate first, second and third portions each have opposite inner and outer surfaces; and a continuous radiating element disposed on the outer surfaces of the dielectric substrate first, second and third portions, wherein a portion of the continuous radiating element disposed on the dielectric substrate first portion is electrically connected to a feed point disposed on the dielectric substrate first portion, and wherein a portion of the continuous radiating element disposed on the dielectric substrate first portion is configured to electrically couple with a portion of the continuous radiating element disposed on the dielectric substrate second portion such that the antenna resonates in at least two separate and distinct frequency bands.

2. A multiple frequency band antenna according to claim 1 further comprising an elongated spacer disposed between the dielectric substrate first and second portions, wherein the elongated spacer comprises opposite first and second surfaces and wherein the spacer first surface is in contacting face-to-face relationship with the inner surface of the dielectric substrate first portion and wherein the spacer second surface is in contacting face-to-face relationship with the inner surface of the dielectric substrate second portion.

3. A multiple frequency band antenna according to claim 2 wherein the spacer comprises an open-celled microcellular polymer.

4. A multiple frequency band antenna according to claim 1 wherein at least a portion of the continuous radiating element has a meandering pattern.

5. A multiple frequency band antenna according to claim 1 wherein the portions of the continuous radiating element disposed on the dielectric substrate first and second portions have different respective electrical lengths.

6. A multiple frequency band antenna according to claim 1 wherein the continuous radiating element comprises a continuous trace of conductive material.

7. A multiple frequency band antenna, comprising:

a C-shaped dielectric substrate comprising opposite first and second spaced apart portions joined at respective adjacent end portions by a third portion, wherein the dielectric substrate first, second and third portions each have opposite inner and outer surfaces;

an elongated dielectric spacer disposed between the first and second portions;

a first radiating element disposed on the dielectric substrate first portion, wherein a portion of the first radiating element is electrically connected to a feed point disposed on the dielectric substrate first portion; and a second radiating element disposed on the dielectric substrate second portion, wherein the first and second radiating elements are electrically connected by a conductive via formed through the dielectric spacer, and wherein the first and second radiating elements are configured to electrically couple with each other such that the antenna resonates within at least two separate and distinct frequency bands.

8. A multiple frequency band antenna according to claim 7 wherein the elongated dielectric spacer comprises opposite first and second surfaces and wherein the dielectric spacer first surface is in contacting face-to-face relationship with the inner surface of the dielectric substrate first portion and wherein the dielectric spacer second surface is in contacting face-to-face relationship with the inner surface of the dielectric substrate second portion.

9. A multiple frequency band antenna according to claim 7 wherein at least one of the first and second radiating elements has a meandering pattern.

10. A multiple frequency band antenna according to claim 7 wherein the first and second radiating elements each comprise a trace of conductive material.

11. A multiple frequency band antenna according to claim 7 wherein the first and second radiating elements have different electrical lengths.

12. A multiple frequency band antenna according to claim 7 wherein at least one of the first and second radiating elements is disposed within a respective one of the first and second portions of the dielectric substrate.

13. A multiple frequency band antenna according to claim 7 wherein the dielectric spacer comprises an open-celled microcellular polymer.

14. A wireless communicator, comprising:

a housing configured to enclose a transceiver that transmits and receives wireless communications signals; and a multiple frequency band antenna electrically connected with the transceiver, comprising:

a C-shaped dielectric substrate comprising opposite first and second spaced apart portions joined at respective adjacent end portions by a third portion, wherein the dielectric substrate first, second and third portions each have opposite inner and outer surfaces, wherein the dielectric substrate first portion has a first length, and wherein the dielectric substrate second portion has a second length less than the first length; and a continuous radiating element disposed on the outer surfaces of the dielectric substrate first, second and third portions, wherein a portion of the continuous radiating element disposed on the dielectric substrate first portion is electrically connected to a feed point disposed on the dielectric substrate first portion, and wherein a portion of the continuous radiating element disposed on the dielectric substrate first portion is configured to electrically couple with a portion of the continuous radiating element disposed on the dielectric substrate second portion such that the antenna resonates within respective different first and second frequency bands.

15. A wireless communicator according to claim 14 further comprising an elongated dielectric spacer disposed between the dielectric substrate first and second portions, wherein the elongated dielectric spacer comprises opposite first and second surfaces and wherein the dielectric spacer first surface is in contacting face-to-face relationship with the inner surface of the dielectric substrate first portion and wherein the dielectric spacer second surface is in contacting face-to-face relationship with the inner surface of the dielectric substrate second portion.

16. A wireless communicator according to claim 14 wherein at least a portion of the continuous radiating element has a meandering pattern.

17. A wireless communicator according to claim 14 wherein the portions of the continuous radiating element disposed on the dielectric substrate first and second portions have different respective electrical lengths.

18. A wireless communicator according to claim 14 wherein the dielectric spacer comprises an open-celled microcellular polymer.

19. A wireless communicator according to claim 14 wherein the continuous radiating element comprises a continuous trace of conductive material.

20. A wireless communicator, comprising:

a housing configured to enclose a transceiver that transmits and receives wireless communications signals; and a multiple frequency band antenna electrically connected with the transceiver, comprising:

a C-shaped dielectric substrate comprising opposite first and second spaced apart portions joined at respective adjacent end portions by a third portion, wherein the dielectric substrate first, second and third portions each have opposite inner and outer surfaces;

a first radiating element disposed on the dielectric substrate first portion, wherein a portion of the first radiating element is electrically connected to a feed point disposed on the dielectric substrate first portion; and a second radiating element disposed on the dielectric substrate second portion, wherein the first and second radiating elements are electrically connected by a conductive via formed through the dielectric spacer, and wherein the first and second radiating elements are configured to electrically couple with each other such that the antenna resonates within at least two separate and distinct first frequency bands.

21. A wireless communicator according to claim 20 further comprising an elongated dielectric spacer disposed between the first and second portions, wherein the elongated dielectric spacer comprises opposite first and second surfaces and wherein the dielectric spacer first surface is in contacting face-to-face relationship with the inner surface of the dielectric substrate first portion and wherein the dielectric spacer second surface is in contacting face-to-face relationship with the inner surface of the dielectric substrate second portion.

22. A wireless communicator according to claim 20 wherein at least one of the first and second radiating elements has a meandering pattern.

23. A wireless communicator according to claim 20 wherein the first and second radiating elements each comprise a trace of conductive material.

24. A wireless communicator according to claim 20 wherein the first and second radiating elements have different electrical lengths.

25. A wireless communicator according to claim 20 wherein at least one of the first and second radiating elements is disposed within a respective one of the first and second portions of the dielectric substrate.

26. A wireless communicator according to claim 20 wherein the dielectric spacer comprises an open-celled microcellular polymer.

* * * * *